US009486379B2

(12) United States Patent
Fallouh

(10) Patent No.: US 9,486,379 B2
(45) Date of Patent: Nov. 8, 2016

(54) DEVICE FOR MAINTAINING A PATIENT IN A POSITION AND METHODS OF USING IT

(71) Applicant: GUY'S AND ST THOMAS' NHS FOUNDATION TRUST, London (GB)

(72) Inventor: Hazem Bahaa Fallouh, London (GB)

(73) Assignee: GUY'S AND ST THOMAS' NHS FOUNDATION TRUST, London (GB)

( * ) Notice: Subject to any disclaimer, the term of this patent is extended or adjusted under 35 U.S.C. 154(b) by 0 days.

(21) Appl. No.: 14/296,942

(22) Filed: Jun. 5, 2014

(65) Prior Publication Data

US 2014/0283846 A1 Sep. 25, 2014

Related U.S. Application Data

(62) Division of application No. 12/448,643, filed as application No. PCT/GB2008/000034 on Jan. 8, 2008, now Pat. No. 8,806,681.

(30) Foreign Application Priority Data

Jan. 9, 2007 (GB) ..... 0700372.6

(51) Int. Cl.
*A61G 13/12* (2006.01)

(52) U.S. Cl.
CPC ..... *A61G 13/122* (2013.01); *A61G 13/12* (2013.01); *A61G 13/121* (2013.01); *A61G 13/125* (2013.01); *A61G 13/1255* (2013.01); *A61G 13/1295* (2013.01)

(58) Field of Classification Search
CPC .... A61G 13/08; A61G 13/12; A61G 13/125; A61G 13/1255; A61G 13/121; A61G 13/122; A61G 13/1295; A61G 13/128; A61G 2017/0237; A61G 17/08
USPC ..... 128/95.1, 96.1, 9.1, 103.1, 106.1, 128/112.1, 117.1, 118.1, 121.1, 123.1, 869, 128/870, 871
See application file for complete search history.

(56) References Cited

U.S. PATENT DOCUMENTS 2,535,559 A * 12/1950 Wolf ..... A61G 13/12 5/621
5,121,512 A * 6/1992 Kaufmann ..... 5/713
5,390,383 A * 2/1995 Carn ..... A61G 13/12 128/877
5,500,964 A * 3/1996 Bergersen ..... A61G 7/001 5/607
5,906,205 A * 5/1999 Hiebert ..... 128/845

(Continued)

FOREIGN PATENT DOCUMENTS

DE 198 48 218 A1 4/2000

OTHER PUBLICATIONS

Hunt et al.; "Helping hands—a simple technique to ensure a secure sternal closure following open cardiac surgery;" Ann R Coll Surg Engl; 2005; 87; p. 63.

*Primary Examiner* — Nicholas Polito
*Assistant Examiner* — David R Hare
(74) *Attorney, Agent, or Firm* — Oliff PLC

(57) ABSTRACT

The invention provides methods and devices for maintaining a patient in a position in which the patient's torso can be moved during surgery, for example by which the sternum can be closed after open chest surgery. The device comprises two contact members for contacting a respective scapula and support means for maintaining the contact members in a grip position in which, in use, each contact member imparts a force on the respective scapula to close the patient's sternum.

19 Claims, 16 Drawing Sheets

(56) References Cited

U.S. PATENT DOCUMENTS 6,076,208 A * 6/2000 Heimbrock et al. ..... 5/613
6,298,511 B1 * 10/2001 Collymore ..... 5/715
6,358,270 B1 * 3/2002 Lemer ..... A61B 17/0642 227/175.1
6,934,987 B2 * 8/2005 Newkirk ..... A61G 13/12 5/430
8,690,807 B2 * 4/2014 Hiebert ..... A61F 5/05833 128/845
8,782,832 B2 * 7/2014 Blyakher ..... A61B 6/0421 5/601
2001/0025391 A1 * 10/2001 Rabaiotti et al. ..... 5/710
2002/0128576 A1 * 9/2002 Mayes ..... 602/33
2005/0160530 A1 * 7/2005 Taguchi et al. ..... 5/618
2007/0143928 A1 * 6/2007 Biggie et al. ..... 5/715
2008/0034502 A1 * 2/2008 Copeland et al. ..... 5/621
2009/0044813 A1 * 2/2009 Gneiting et al. ..... 128/845
2009/0227929 A1 * 9/2009 Gondringer ..... 602/33

* cited by examiner

DEVICE FOR MAINTAINING A PATIENT IN A POSITION AND METHODS OF USING IT

This is a Division of application Ser. No. 12/448,643, filed Jun. 29, 2009, which in turn is a National Phase of PCT/GB2008/0000034, filed Jan. 8, 2008, which claims foreign priority to GB Application No. 0700372.6, filed Jan. 9, 2007. The disclosures of the prior applications are hereby incorporated by reference herein in their entirety.

The present invention relates to a device for use after open chest surgery via sternotomy incision. In particular the present invention relates to a device for maintaining a patient in a position during surgery, for instance a position in which the sternum can be closed after open chest surgery and to methods of using the device.

Sternotomy is a surgical procedure in which an incision is made in the sternum to divide or open the sternum longitudinally to provide access to the chest cavity to allow heart and/or lung surgery.

After the heart/lung surgery is complete, it is necessary to close the chest cavity by aligning the edges of the divided sternum and securing the edges together. This is typically achieved by threading metal wires through the patient's sternum whilst the chest cavity is still open, forcing the edges of the divided sternum into alignment, pulling the wires tight to hold the edges together and twisting the wires to fix the sternum position.

The forcing together of the divided sternum edges is typically achieved by an assistant surgeon or anaesthetist placing their palms underneath the patient's torso and manually raising the patient's scapulae (shoulder blades). At the same time, the surgeon pulls on the metal wires to assist in the alignment.

Such a procedure has numerous problems. Firstly, the force required to align the divided sternum edges is considerable even for smaller patients and, obviously, the necessary force increases as patient size increases. Closing of the chest cavity typically takes around ten minutes and the assistant surgeon or anaesthetist is required to maintain the raised position of the patient's shoulders for the duration. Often, the assistant surgeon (if, indeed, one is present) or anaesthetist is often physically incapable of maintaining the patient's shoulders in the required position for the required length of time. Therefore, the assistant surgeon/anaesthetist may need to rest during the procedure. Furthermore, whilst the anaesthetist is involved in raising and maintaining the position of the patient's shoulder, he/she is unable to concentrate on the primary role of anaesthesia.

To assist in the forcing together of the divided sternum and/or to hold the edges of the sternum together if the assistant surgeon/anaesthetist is resting or unavailable to perform the manoeuvre, the wires threaded through the patient's sternum are often used to pull the edges of the sternum together. This can result in the wires cutting through if the bone is soft or breakage of the wire. This very time consuming with potential risk of increased bleeding because all of the wires have to be removed and the wiring procedure recommenced from the start.

The present invention aims to ameliorate at least some of the problems described above and provides a device and a method of using the device which will maintain the patient in a position in which alignment of the sternum edges is facilitated without requiring excessive force. This will reduce the incidence of wire breakages/displacement and will also relieve the assistant surgeon or anaesthetist from prolonged physical effort. In certain embodiments the device comprises additional means for manipulating the torso more generally e.g. to lift the spine of the patient, or to roll or wedge the patient towards one side to simplify access for the surgeon in performing the relevent procedure.

Accordingly, in a first aspect, the present invention provides a device for maintaining a patient in a position in which the patient's sternum can be closed after open chest surgery, said device comprising two contact members for contacting a respective scapula and support means for maintaining the contact members in a grip position in which, in use, each contact member imparts a force on the respective scapula to close the patient's sternum.

The contact members take the place of the assistant surgeon's/anaesthetist's hands under the patient's scapulae. In the grip position, the contact members can apply forces, e.g. opposing lateral forces, to raise and squeeze the scapulae which closes the sternum. The support means can maintain the contact members in the grip position for the required period of time to allow closure of the chest cavity without requiring any physical effort by the assistant surgeon/anaesthetist and without requiring excessive tension on the wires to approximate the two edges of the sternum.

Preferably, the support means are adapted such that can releasably maintain the contact members in the grip position. Accordingly, after closure of the chest cavity is complete, the contact members can be released from the grip position.

Preferably, the support means are adapted to move the contact members from a rest position into the grip position. By providing a device which can move the contact members into the grip position in which they can raise and squeeze the patient's scapulae, the sternum can be closed with reduced or minimal effort on the part of the assistant surgeon/anaesthetist and without requiring excessive pulling of the metal wires.

Preferably, the support means are adapted to move the contact members from a substantially horizontal rest position in which substantially no lateral force can be applied to the scapulae into the grip position in which opposing lateral forces can be applied to the scapulae.

By providing contact members which can lie in a substantially horizontal rest position, the contact members can lie flat against the operating table during surgery. This will prevent them from hindering the surgery. When closure of the chest cavity is required after surgery, the contact members can be moved by the support means into the grip position. In the grip position, each contact member can abut the respective scapula so that the contact members can raise the scapulae from the operating table and squeeze them towards each other to bring the edges of the divided sternum together.

Most preferably, the support means are adapted such that they can move the contact members from the grip position back to the substantially horizontal rest position. This allows the contact members to lie flat on the operating table after closure of the chest cavity is complete so that the device does not impinge on the patient or so that it can easily be removed from under the patient.

Preferably, the support means are adapted to move the contact members into the grip position by raising at least part of the edges of the contact members which, in use, are remote from the patient's midline (hereinafter called "the outermost edges").

The support means may be, for example, mechanical, pneumatic or hydraulic.

For example, the support means may include at least one ratchet mechanism which, in use, allows raising (e.g. manual raising) of at least part of the contact members (e.g. at least part of the outermost edges of the contact members), for example, from the surface of an operating table, and can then lock the raised grip position of the contact members.

Preferably, the ratchet mechanism includes a release catch to allow subsequent lowering of the contact members.

Alternatively, the support means may include at least one winch and cable. Most preferably the at least one winch is an electric winch such that the contact members can be moved to the grip position without any physical effort. The at least one cable may be connected to or may extend through the contact members such that winding of the cable onto the winch causes raising of the outermost edges of the contact members. The wound cable thus maintains the outermost edges of the contact members in the raised position in which the contact members can apply opposing lateral forces on the scapulae.

In yet further embodiments, the support means may be pneumatic or hydraulic, most preferably electrically operated pneumatic or hydraulic support means so that the contact members can be moved into and maintained in the grip position without any physical effort by the assistant surgeon/aneasthetist. Preferably, the support means includes an inflatable bladder located on the underside of each contact member (i.e. on the opposite side to that which can abut the patient in the grip position). Preferably, the inflatable bladders are reversibly inflatable/deflatable. The inflatable bladders preferably have a sufficiently low profile in the deflated state that the contact members can lie substantially flat on an operating table with the inflatable bladders between the contact members and the operating table. In the inflated state, the inflatable bladders can push at least part of the contact members (e.g. the outermost edges) from the operating table into the grip position and can maintain them in this position in which the contact members can apply opposing lateral forces on the scapulae.

The contact members may be joined to a base portion which, in use, is positioned directly under the patient's midline. This helps positioning of the device and also reduces the number of separate parts of the device. The contact members may be pivotable along the join with the base portion. For example, the support means may be adapted to maintain a grip position in which the contact members are inclined relative to the base portion. Preferably the support means are adapted to pivot the contact members from the rest position in which both the contact members and the base portion are substantially horizontal, to the grip position in which the contact members are inclined relative to the base portion.

The contact members and base portion may be integral. For example, the contact members and base portion may be formed of a single sheet of flexible material e.g. cloth or plastics material.

The outermost edges of the contact members are preferably mounted on a frame which cooperates with the support means. The support means can maintain a raised position of at least part of the frame e.g. above the level of an operating table, such that at least part of the outermost edges of the contact members are suspended from the frame in the grip position. For example, if the contact members and base portion are a single sheet of flexible material, the sheet of material can form a hammock structure in which the upper torso of a patient may be gripped.

Preferably, the frame has side arms which extend at least partly along the outermost edges of the contact members and a crossbar which joins the side arms, the crossbar cooperating with the support means. The crossbar can be raised (e.g. manually) to move the frame from a rest position (in which the crossbar and side arms are substantially horizontal) to the grip position in which the side arms are inclined to the horizontal so that the outermost edges of the contact members proximal the crossbar are suspended from the side arms. The support means can maintain the raised position of the crossbar to maintain the contact members in the grip position.

The contact members and optionally the base portion may be formed of a series of slats e.g. padded slats, preferably extending in a direction which, in use, is parallel to the patient's midline. Most preferably, the slats have a wider base (remote from the patient in use) and a narrower top (adjacent the patient in use) when viewed in a transverse cross-section, i.e. the slats have a trapezoid shaped transverse cross section. This means that the bases of adjacent slats are closer to each other than the tops of adjacent slats. The bases of at least some of the slats are connected to the bases of the adjacent slat(s) at a hinge and the support means act to maintain the slats in a position in which they are pivoted at these hinges such that the tops of the adjacent slats approach each other. Most preferably, the support means are adapted to move the slats into this "curled" grip position in which the outermost slats (i.e. the contact members) can exert a lateral force on the patient's scapulae.

In these embodiments, the support means may include a cable and winch (as described above). The or each cable extends through the slats such that, in use, it transverses the patient's midline. The or each cable preferably extends through the slats above the base of each slat. When the cable length is maximal, the contact members lie in a horizontal orientation, i.e. they can lie flat against an operating table. As the cable length extending through the slats is reduced by the winch, the tops of the slats are pulled towards each other and the contact members are curled into the grip position in which they can raise and squeeze the patient's scapulae. Maintaining the reduced length of cable extending through the slats maintains the contact members in the grip position.

Preferably, the contact members may include at least one protrudeable element. This at least one protrudeable element can be used for increasing the lateral forces to the respective scapula when the contact members are in the grip position.

Preferably, the contact members include a plurality of protrudeable elements. These protrudeable elements may be arranged such that, in use, they are aligned with the patient's midline or they may be arranged such that, in use, they are transverse to the patient's midline.

The protrudeable elements are preferably selectively protrudeable. For example, when the elements are arranged such that, in use, they are aligned with the patient's midline, they can be selectively protruded to apply extra force on the patient's scapulae. For a smaller patient, extra force can be applied using protrudeable elements located, in use, proximal to the patient's midline. For a larger patient, extra force can be applied using protrudeable elements located, in use, remote from the patient's midline.

Most preferably, the protrudeable elements are inflatable elements.

In one embodiment the device further comprises a further independent torso-moving means which is in use situated beneath the patient's midline. For example it may be provided on or by the base portion discussed above, between the contact members. This torso-moving means may take the form of a patient's midline support means in similar terms to the support means described above e.g. mechanical, pneumatic or hydraulic. In one embodiment it is an inflatable cell which contacts the patient's spine. The torso moving means is adapted to rise from the base portion, thus providing for additional manipulation of the patient and offering the surgeon simplified access during surgery. For example the torso-moving means may apply pressure to open the sternum, or to angle the patient (using both the midline support and the contact members) where that might be desired e.g. during surgery on the breast. Preferably this torso-moving means is symmetrical and curved in cross section when raised, with the apex being adapted to contact the patient's midline. In other embodiments it may be trapezoid as described above.

In a second aspect, the present invention provides a method of manipulating a patient during, prior, or after, surgery, comprising use of the device above. In a preferred embodiment the method is for maintaining a patient in a position in which the patient's sternum can be closed after open chest surgery, said method comprising: providing a device having two contact members and support means for maintaining a grip position of the contact members in which the contact members can impart a force on the respective scapula to close the patient's sternum; positioning the contact members of the device underneath a respective scapula of the patient; moving the contact members into the grip position; and maintaining the contact members in the grip position using the support means.

Preferably, the method comprises positioning the contact members underneath a respective scapula of the patient in a substantially horizontal orientation in which substantially no lateral force is applied to the scapulae and moving the contact members into the grip position in which opposing lateral forces are applied to the scapulae.

The method preferably comprises raising at least part of the outermost edges of the contact members.

Preferably, the method comprises moving the contact members into the grip position using the support means.

Preferably, the method comprises maintaining the contact members in the grip position by mechanical support means e.g. a ratchet mechanism or a winch, or by pneumatic or hydraulic support means.

For example, the method may involve moving (e.g. manually raising) at least part of the contact members (e.g. at least part of the outermost edges) and locking the raised position using a ratchet mechanism to maintain the contact members in the grip position.

Alternatively, the method may comprise moving the contact members to and/or maintaining the contact members in the grip position of the contact members using at least one winch and cable. Most preferably the method comprises using an electric winch such that the contact members are moved to the grip position without any physical effort.

In yet further embodiments, the method comprises moving the contact members to and/or maintaining the contact members in the grip position using pneumatic or hydraulic support means. Preferably, the method comprises providing a device having an inflatable bladder located on the underside of each contact member (i.e. on the opposite side to that which can abut the patient in the grip position) and inflating the bladders to push at least part of the contact members (e.g. the outermost edges) from the operating table into the grip position. The method preferably includes using inflatable bladders to maintain the outermost edges in this position in which the contact members can apply opposing lateral forces on the scapulae.

Preferably, the method comprises providing a device in which the contact members are joined to a base portion and positioning the base portion under the patient's midline. Preferably, the method comprises pivoting the contact members at the join with the base portion from a substantially horizontal rest position to the grip position in which both contact members are inclined relative to the base.

In some embodiments, the method comprises providing a device having a frame with side arms which extend at least partly along the outermost edges of the contact members and moving the frame to move the contact members into the grip position. More preferably, the method comprises providing a frame which further includes a crossbar joining the side arms and raising the crossbar, e.g. above the level of the operating table, such that the side arms are moved from a horizontal position to the grip position in which the side arms are inclined to the horizontal and the outermost edges of the contact members proximal the crossbar are suspended from the side arms.

In other embodiments, the method comprises providing a device in which the contact members and optionally the base portion are formed of a series of slats e.g. padded slats, preferably extending in a direction parallel to the patient's midline. Most preferably, the slats have a wider base (remote from the patient in use) and a narrower top (adjacent the patient in use), i.e. the bases of adjacent slats are closer to each other than the tops of adjacent slats. In this case, the bases of at least some of the slats are connected to the bases of the adjacent slats at a pivotable hinge. The method preferably comprises moving the contact members by pivoting the slats at these hinges such that the tops of the slats move towards each other. This results in the contact members and base portion "curling" into the grip position which the outermost slats (i.e. the contact members) exert a lateral force on the patient's scapulae.

In these embodiments, the method preferably comprises providing a device having a cable and winch as the support means (as described above). The or each cable extends through the slats such that it transverses the patient's midline. The or each cable preferably extends through the slats above the base of each slat. When the cable length is maximal, the contact members are positioned beneath the patient's scapulae in a horizontal orientation, i.e. they lie flat against an operating table. Reducing the cable length by the winch, pulls the tops of the slats towards each other and the contact members curl into the grip position in which they raise and squeeze the patient's scapulae.

Preferably, the method further comprises providing at least one protrudeable element on each contact members and causing the protrudeable elements to protrude from the contact member to increase the lateral force to the respective scapula in the grip position.

Preferably, the method comprises providing a plurality of protrudeable elements, preferably arranged such that they are aligned with or transverse to the patient's midline. The method preferably comprises selectively causing the protrudeable elements to protrude. For example, when the elements are aligned with the patient's midline, they are selectively protruded to apply extra force on the patient's scapulae. For a smaller patient, extra force is applied by causing protrudeable elements located proximal to the patient's midline to protrude. For a larger patient, extra force can be applied by causing protrudeable elements located remote from the patient's midline to protrude.

Most preferably, the protrudeable elements are inflatable elements and the method comprises inflating (preferably selectively inflating) the protrudeable elements.

Preferably, the method further comprises releasing the contact members from the grip position after closure of the chest cavity is complete.

The method may comprise operating or raising the torso-moving means (if present) situated beneath the patient's midline such as to manipulate the patient to offer the surgeon simplified access during surgery—e.g. to angle the patient where that might be desired.

In a third aspect, the present invention provides a method of closing a patient's sternum after open chest surgery, said method comprising: providing a device having two contact members and support means for maintaining a grip position of the contact members in which the contact members can impart a force on the respective scapula to close the patient's sternum; positioning the contact members of the device underneath a respective scapula of the patient; moving the contact members into the grip position; maintaining the contact members in the grip position using the support means and fixing the sternum in a closed position.

Preferably, the method of the third aspect comprises the steps discussed previously for the second aspect.

Preferably, the method comprises fixing the sternum in the closed position by twisting wires attached to the patient's intersect muscles.

Further aspects of the invention include use of the device of the first aspect for manipulating a patient during surgery, and for the methods of the second or third aspect.

Preferred embodiments of the present invention will now be described with reference to the accompanying figures in which:

FIG. 1 shows a perspective view of the first preferred embodiment in a rest position i.e. when the contact members are not in the grip position.

Figure 1:
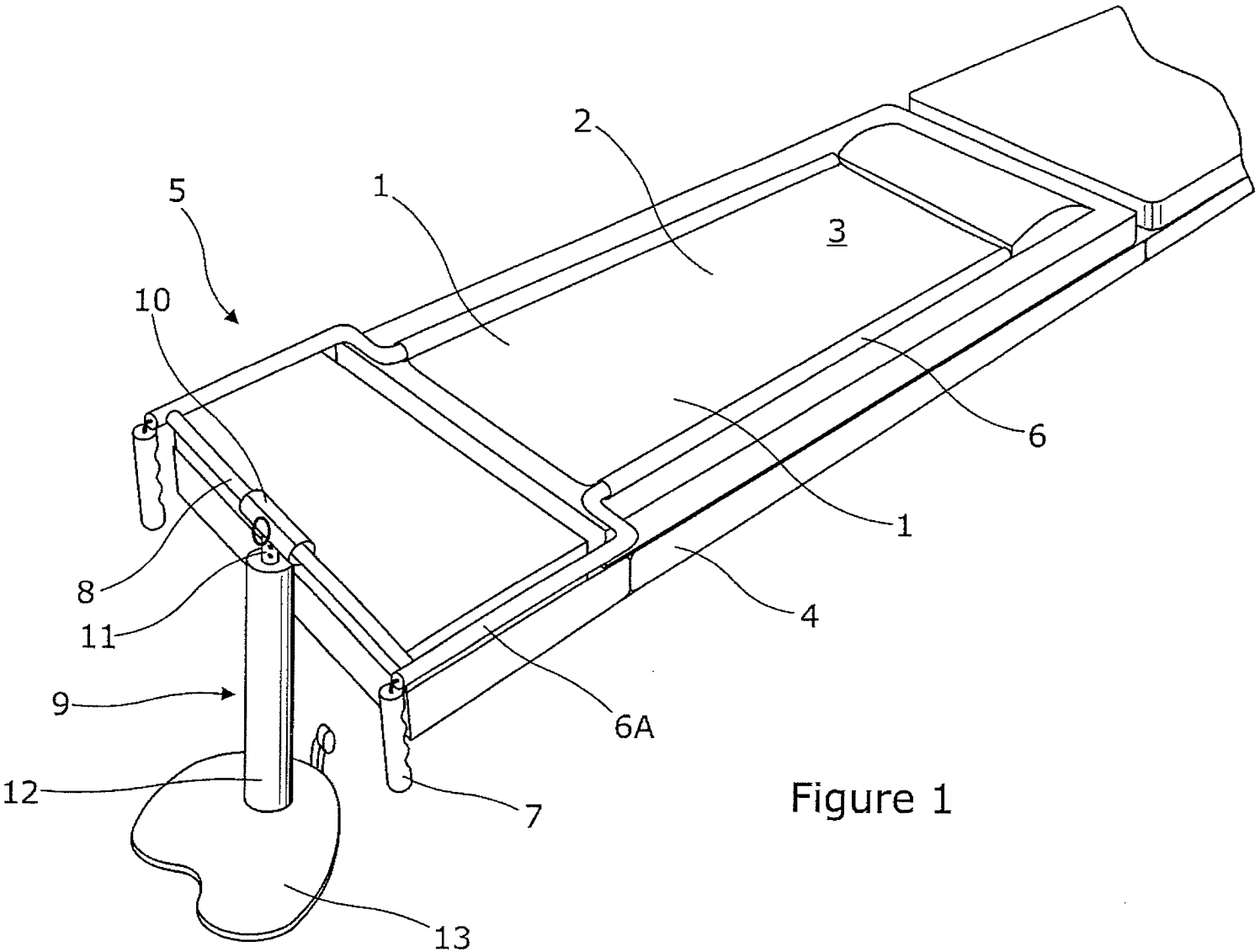
FIG. 1 shows a perspective view of a first preferred embodiment in a rest position.

The device includes a two contact members 1 which are integral with a base portion 2 and together form a single sheet 3 of cloth material. The edges of the contact members are connected to a frame 5 comprising side arms 6 which extend along the length of the edges. The side arms 6 extend from and parallel to the edges of the contact members to form a wider portion 6A in which the side arms are more widely spaced. The wider portion provides a space in which the patient's head can lie (see FIGS. 2A and 2B). The side arms 6 terminate in handles 7 which are hinged and can rest perpendicularly to the side arms against the end of an operating table.

The two side arms 6 are connected by a crossbar 8 which cooperates with the support means 9. The support means comprises a ratchet mechanism provided within a hollow rod 12, the mechanism cooperating with recesses on a vertical bar 11 to allow extension of the vertical bar 11 from the hollow rod 12 but to prevent retraction of the bar. The vertical bar 11 terminates in a sleeve 10 in which the crossbar 8 rests. The hollow rod 12 terminates in a foot plate 13.

In the rest position (as shown in FIG. 1), the sheet 3 is laid onto an operating table 4 such that the sheet is flat/horizontal i.e. the contact members and base portion are all supported on the operating table 4. The handles 7 hang vertically from the side arms 6 to rest against the end of the operating table so that they do not hinder movement of the anaesthetist or surgeon around the patient.

Figure 2A:
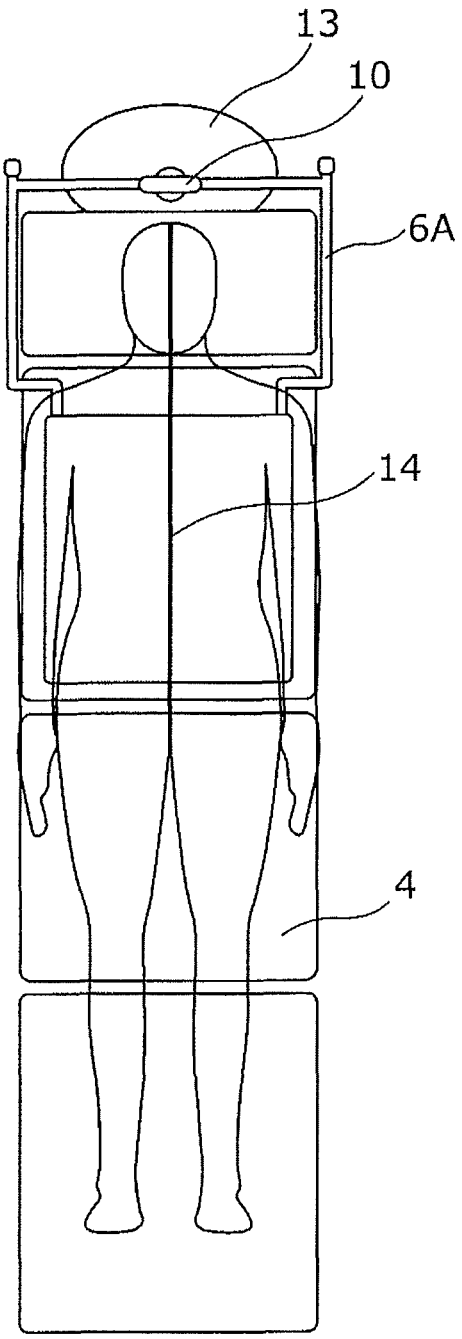
FIGS. 2A and 2B show overhead views of the first preferred embodiment in the rest position.
Figure 2B:
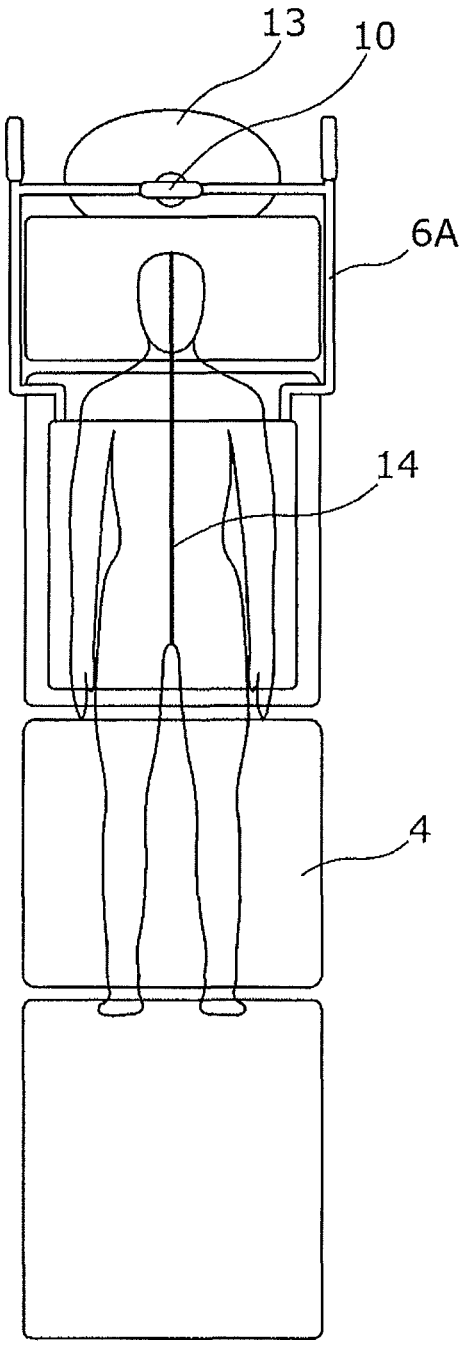

The patient is positioned on the sheet 3 prior to open chest surgery as shown in FIGS. 2A and 2B. FIG. 2A shows the positioning of a large patient whilst FIG. 2B shows the positioning of a smaller patient. In both cases, the midline 14 of the patient is positioned on the base portion 2 with the contact members 1 lying beneath the patient's scapulae. The patient's head lies on the operating table 4 in the space created by the wider portion 6A of the side arms 6.

Figure 3:
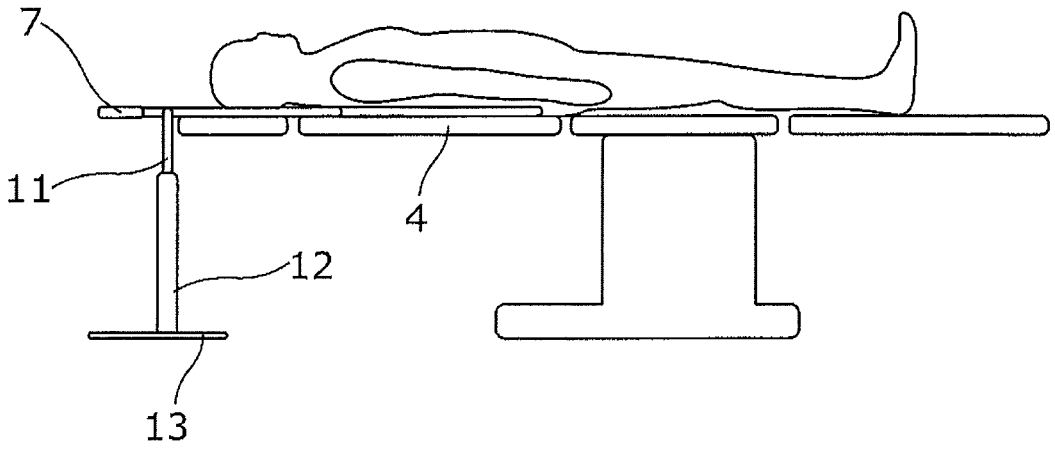
FIG. 3 shows a side view of the first preferred embodiment in the rest position.

FIG. 3 shows a side view of the first embodiment in the rest position just prior to movement of the contact members 1 into the grip position. In this view it can be seen that the contact members 1, base portion 2 and side arms 6 of the device are horizontal i.e. in the same plane as the operating table 4. The handles 7 are pivoted from a vertical position (shown in FIG. 1) to a horizontal position in the same plane as the side arms 6 (as shown in FIGS. 2B and 3)

Figure 4:
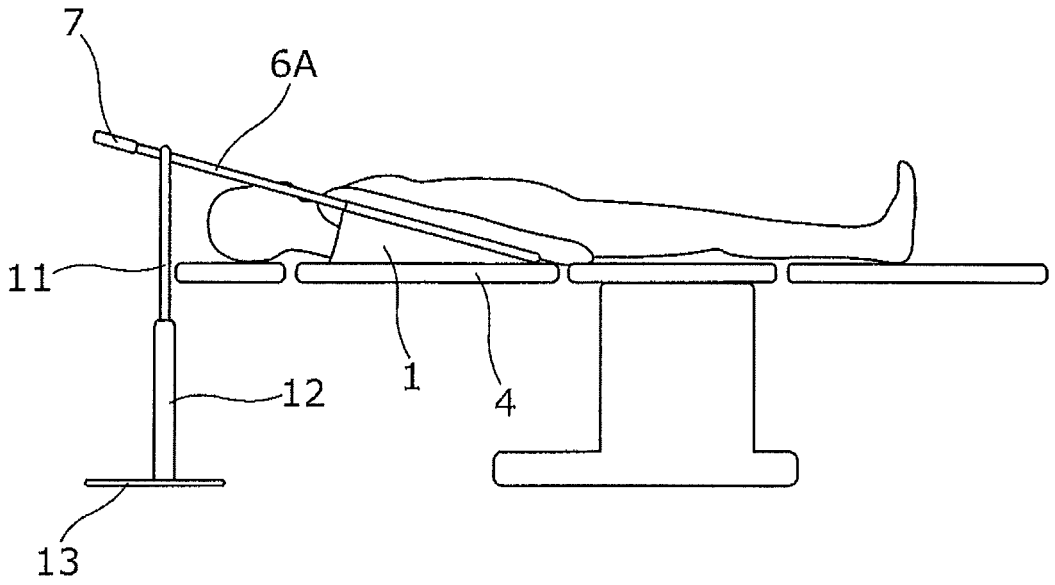
FIG. 4 shows a perspective view of the first preferred embodiment in the grip position.
Figure 5:
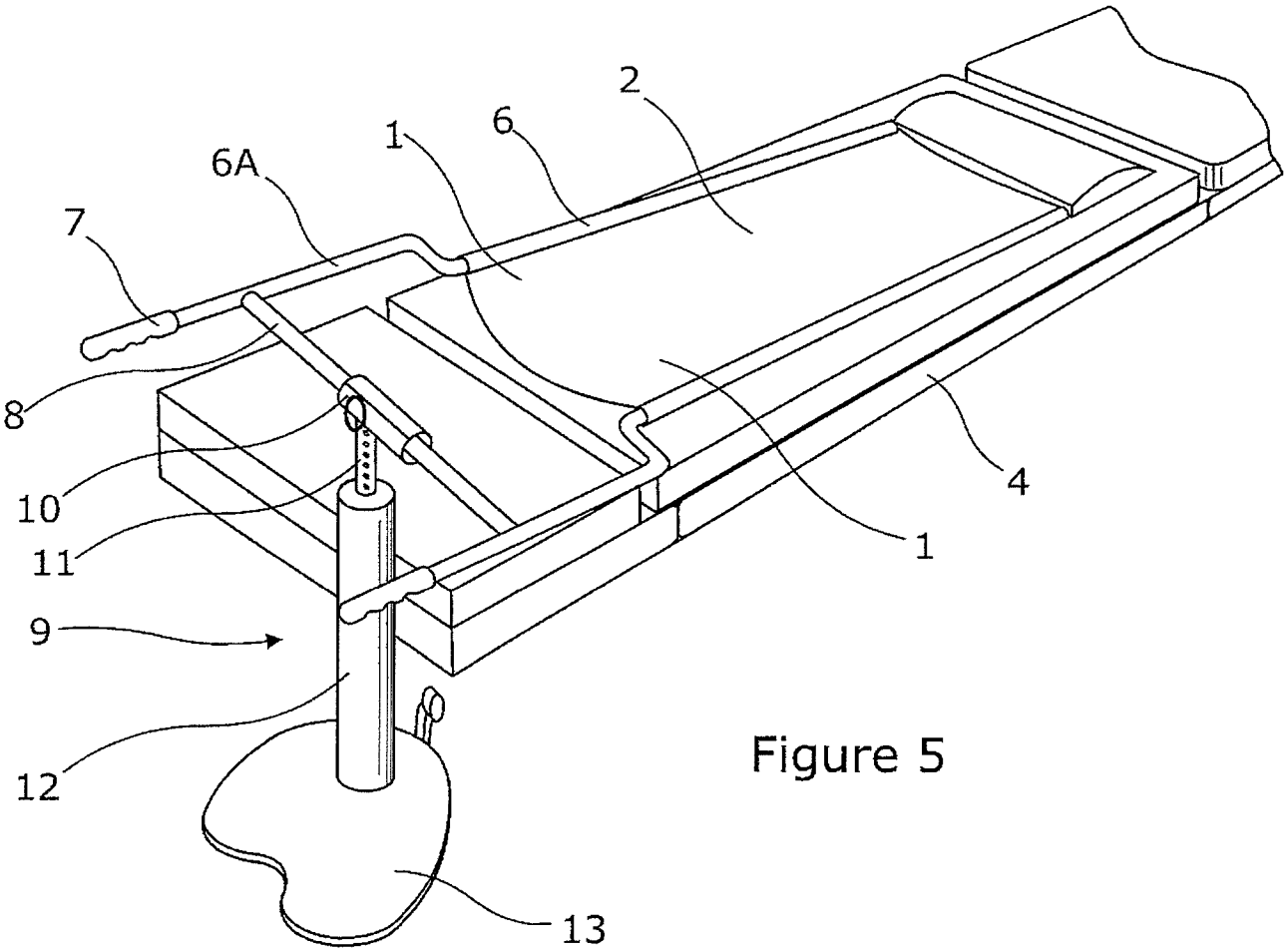
FIG. 5 shows a side view of the first preferred embodiment in the grip position.

FIGS. 4 and 5 show the first preferred embodiment in the grip position. To move the contact members from the rest position shown in FIGS. 1 and 3 to the grip position shown in FIGS. 4 and 5, the handles 7 are manually raised which extends the vertical bar 11 from the hollow rod 12. The ratchet mechanism allows the extension but prevents retraction of the bar 11 into the hollow rod 12 (thus maintaining the bar 11 at the desired extension without any physical effort on the part of the assistant surgeon/anaesthetist). The assistant surgeon/anaesthetist can place their feet on the enlarged base 13 as the vertical bar 11 is extended from the hollow rod 12 to prevent any movement of the hollow rod.

As the vertical bar 11 is extended from the hollow rod, the crossbar 8 and the ends of the side arms 6 connected to the crossbar 8 are raised from the horizontal i.e. from the operating table 4, such that the side arms 6 are inclined to the horizontal. This causes the outermost edges of the contact members proximal the crossbar 8 to be raised from the operating table 4 (with the base portion remaining on the operating table beneath the patient's midline). Thus the sheet 3 forms a hammock in which the patient's upper torso is gripped. The sides of the sheet 3 (i.e. the contact members 1) apply a lateral force to the patient's scapulae which pushes the divided edges of the sternum together allowing the surgeon to twist metal wires secured through the patient's intercostal muscles to fix the sternum position.

After the position of the sternum has been fixed, a release catch (not shown) can be used to release the ratchet mechanism to allow retraction of the vertical bar 11 into the hollow rod 12 to lower the side arms 6 and contact members 6 back to their horizontal rest position.

Figure 6:
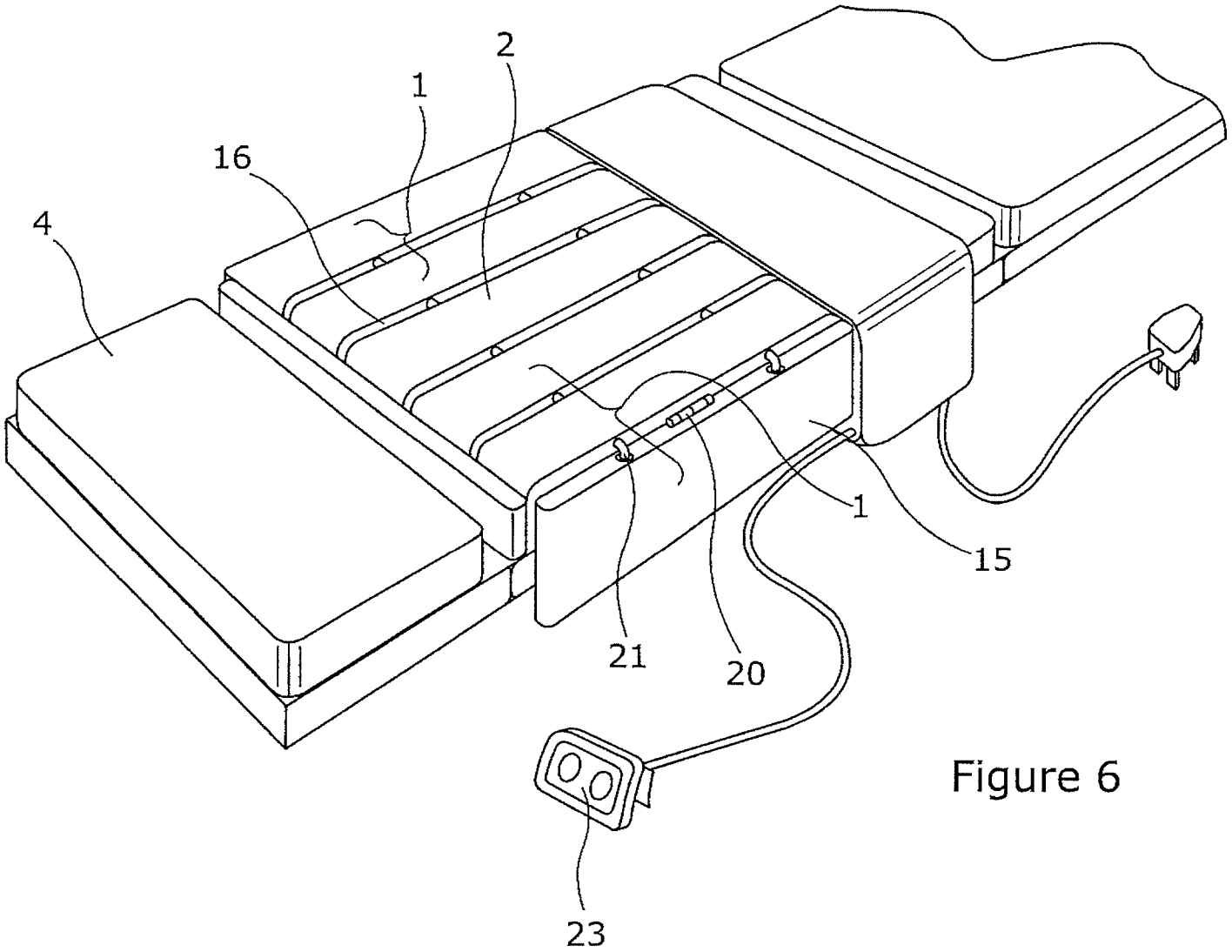
FIG. 6 shows a perspective view of a second preferred embodiment in a rest position.

FIG. 6 shows a perspective view of a second preferred embodiment in the rest position i.e. when the contact members 1 are not in the grip position.

Figure 7A:
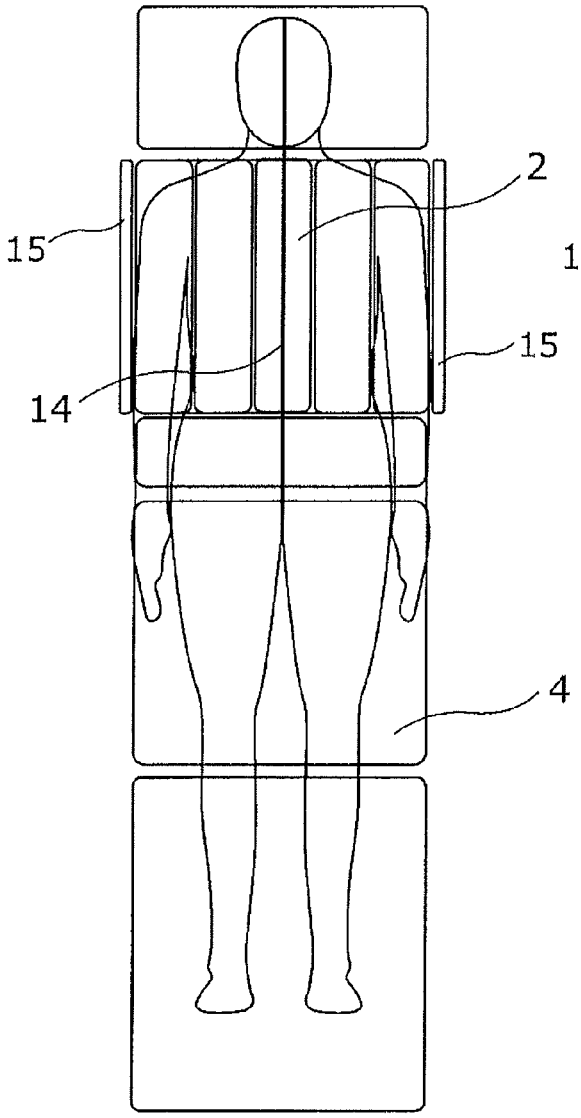
FIGS. 7A and 7B show overhead views of the second preferred embodiment in the rest position.
Figure 7B:
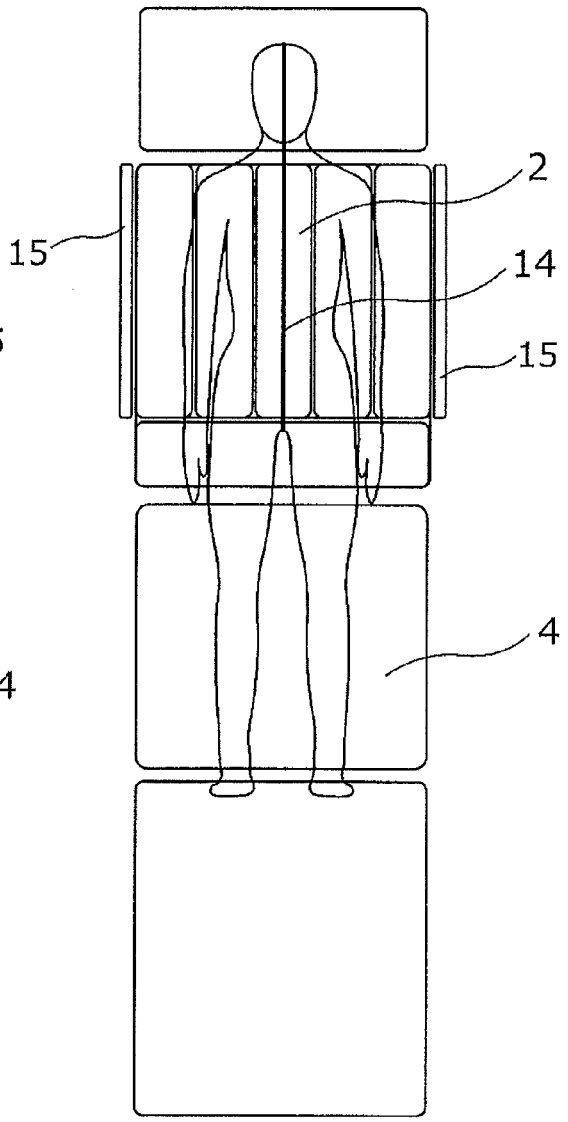

The contact members 1 and base portion 2 comprise padded slats 15 which are aligned with the patient's midline as shown in FIGS. 7A (larger patient) and 7B (smaller patient). The base portion slat is positioned directly underneath the patient's midline 14 and the contact member slats 1 are positioned underneath the patient's scapulae. For larger patients (see FIGS. 7A, 8A and 8B), the number of slats comprising the contact members will be greater than for a smaller patient (see FIGS. 7B, 9A and 9B). In the rest position, the outermost slats 15 are folded underneath the adjacent slats (see FIGS. 8A and 9A) or they hang perpendicularly from the adjacent slats against the sides on the operating table 4 (see FIG. 6). This to ensure that the outermost slats 15 do not impede surgery.

Each slat has a wider base (for positioning against the operating table) and narrower top (on which the patient can rest) giving each slat a trapezoidal transverse cross-section (as shown in FIGS. 8A, 8B, 9A and 9B). This provides spaces 16 between the tops of adjacent slats.

Figure 10:
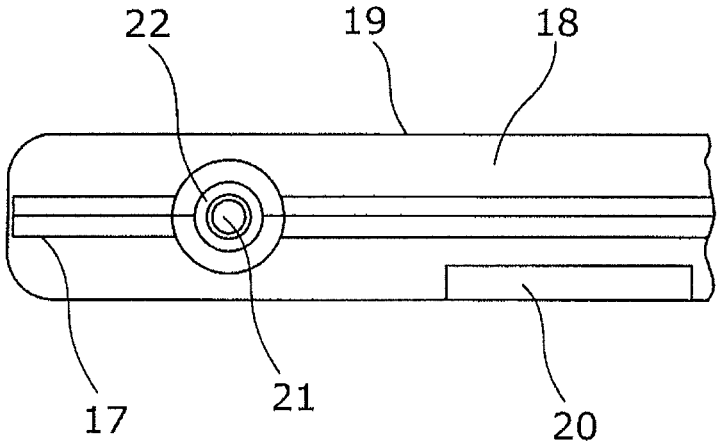
FIG. 10 shows a longitudinal cross section through a slat of the second preferred embodiment.

A longitudinal cross section through a slat is shown in FIG. 10. Each slat comprises a rigid slat 17 surrounded by padding 18 and having an outer coating 19, e.g. of PVC. Each slat is joined to the adjacent slat(s) at a tubular hinge 20 with a pin pivot. Extending transversely through each slat are two cables 21 (only one shown in FIG. 10) e.g. 2 mm diameter nylon cables surround by a respective cable sheath 22. The cables extend to a winch (not shown) which is actuated using an electronic control panel 23.

Figure 8A:
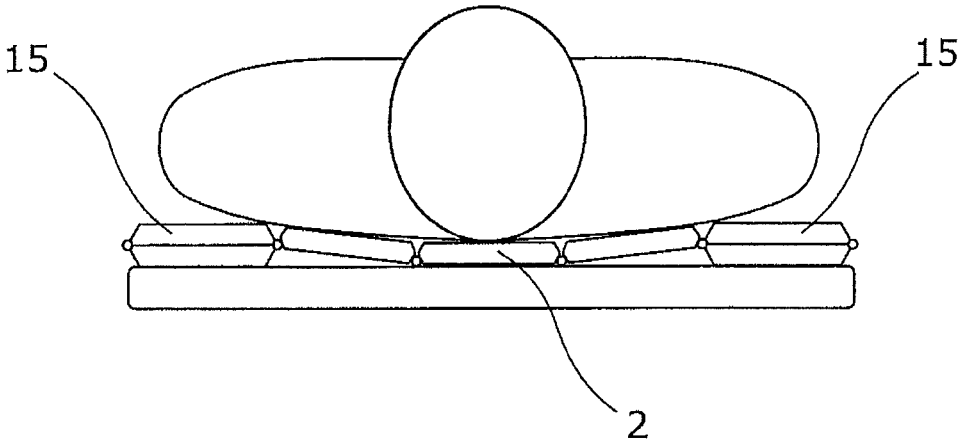
FIGS. 8A and 8B show end views of the second preferred embodiment in the rest and grip positions for a larger patient.
Figure 8B:
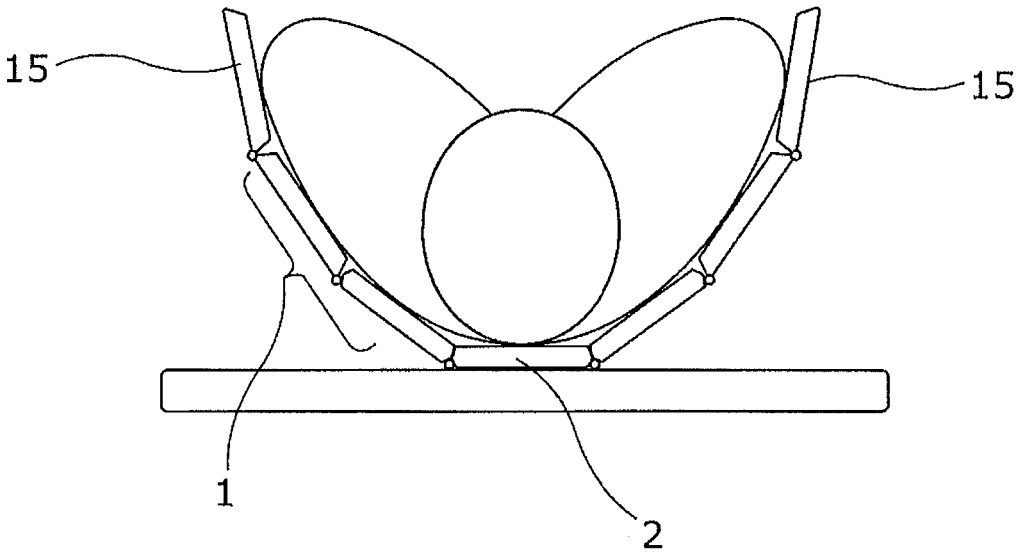
Figure 9A:
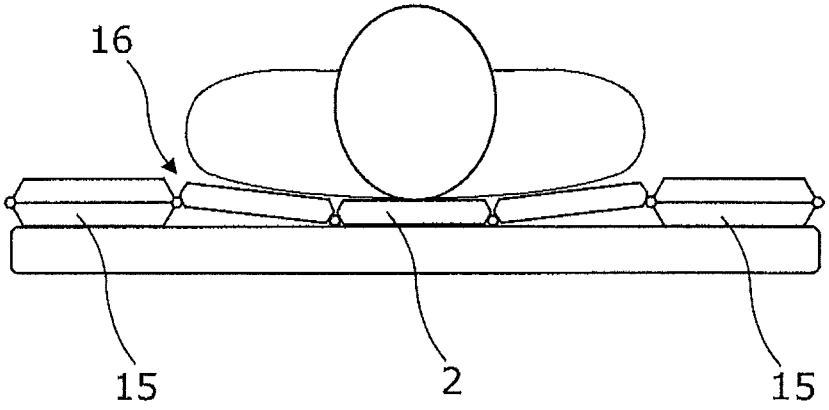
FIGS. 9A and 9B show end views of the second preferred embodiment in the rest and grip positions for a smaller patient.
Figure 9B:
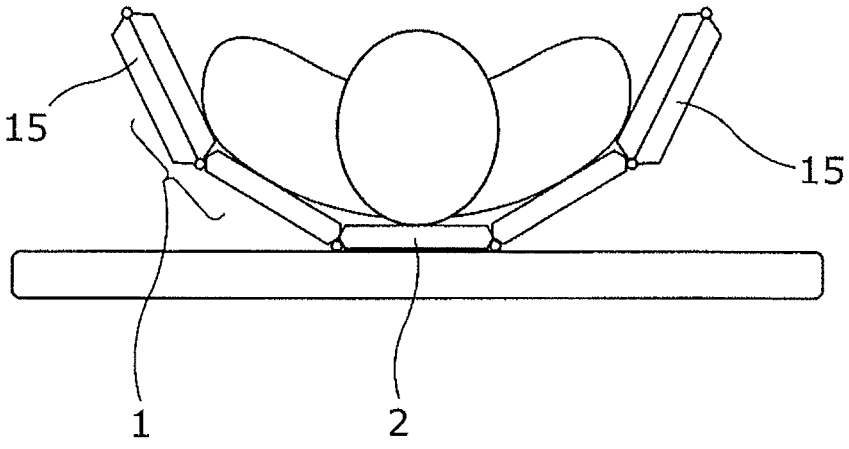
Figure 11:
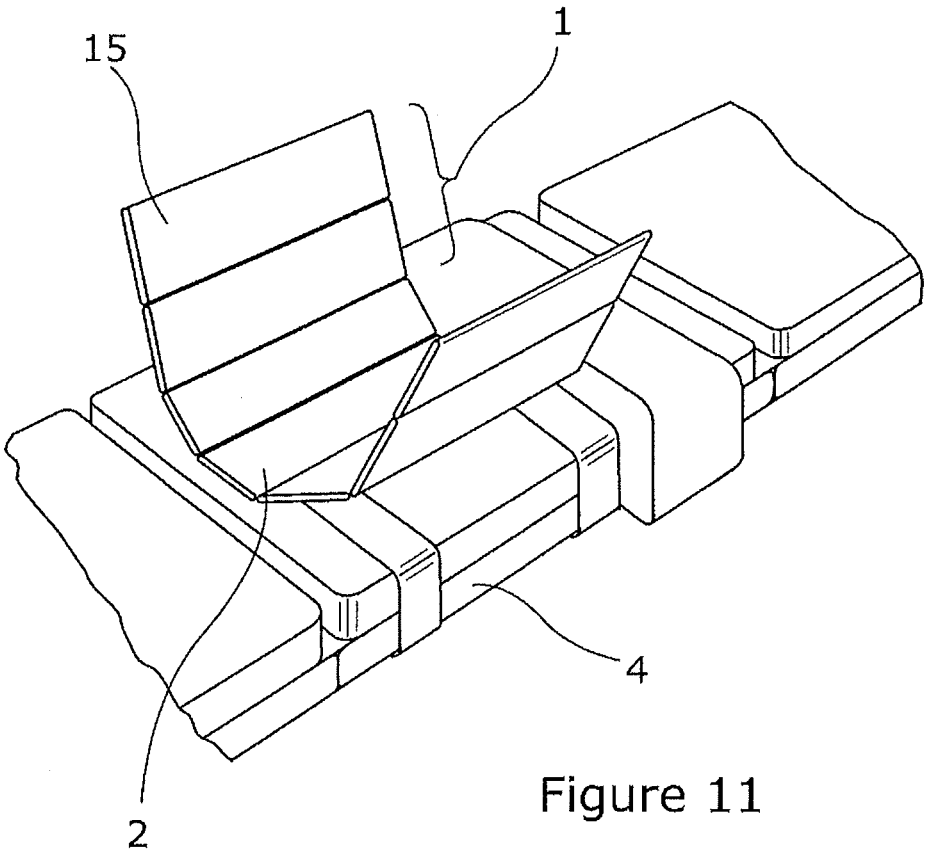
FIG. 11 shows perspective view of the second preferred embodiment in the grip position.

As shown in FIGS. 6, 8A and 9A, in the rest position, the slats lie substantially horizontally on the operating table 4 (although with the outermost slats folded underneath the adjacent slats as shown in FIGS. 8A and 9A, the contact members 1 are not strictly horizontal). In the rest position, the length of cable 21 extending through the slats will be maximal. To move the contact members into the grip position, the electric winch is used to reduce the length of the cables 21 extending through the slats by winding the cables 21 onto the winch. As the length of the cables 21 is reduced, the slats pivot at the hinges 20 so that the tops of adjacent slats move together to close the spaces 16 (see FIGS. 8B and 9B). This pivoting causes the contact members 1 to curl inwards into the grip position in which they raise and squeeze the patients' scapulae. For larger patients, the outermost slats are extended to ensure that the patients upper torso is securely gripped (see FIG. 8B). FIG. 11 shows a perspective view of the second preferred embodiment in the grip position with the outermost slats 15 extended.

After the sternum position is fixed, the cables 21 can be unwound from the winch to lower the contact member slats 1 to return them to their rest position.

Figure 12:
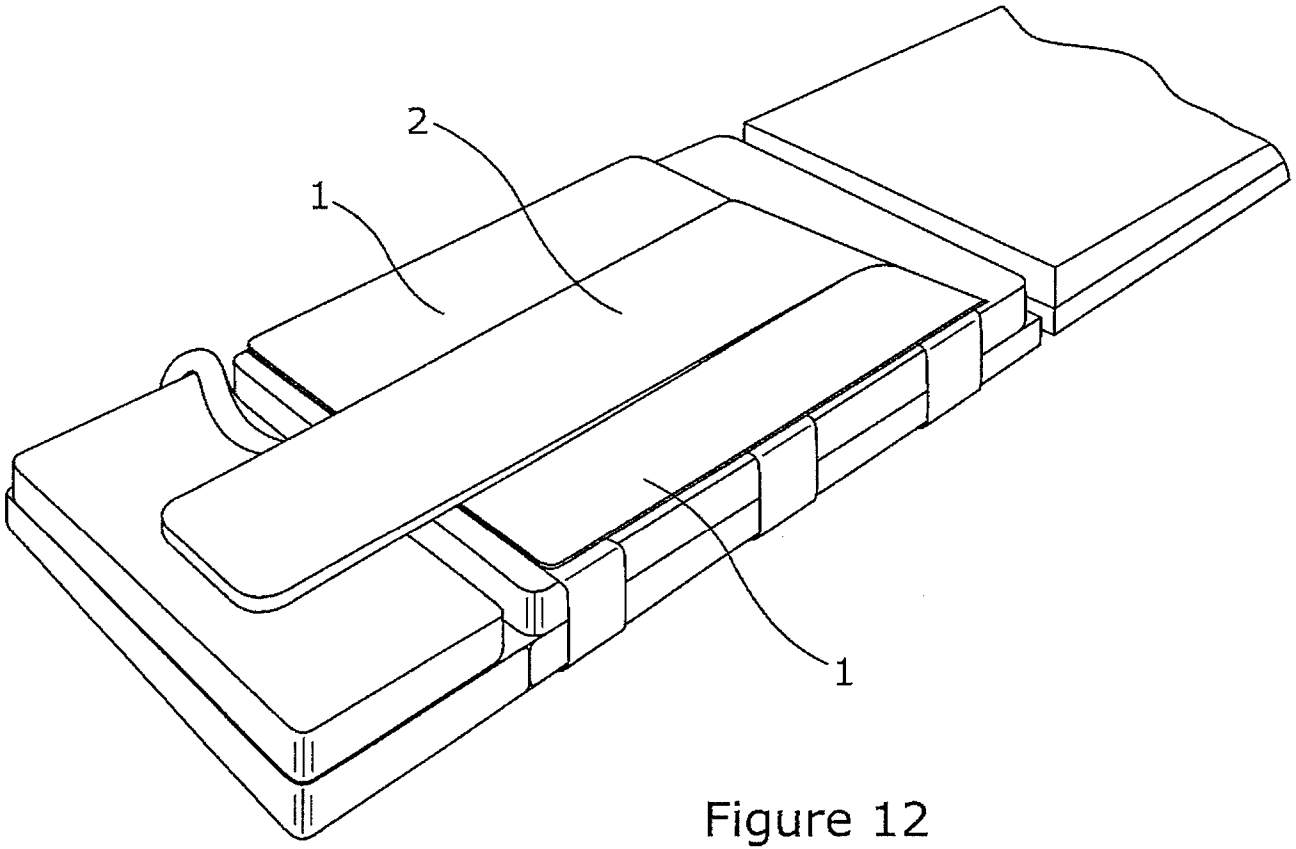
FIG. 12 shows perspective view of a third preferred embodiment in the rest position.
Figure 13A:
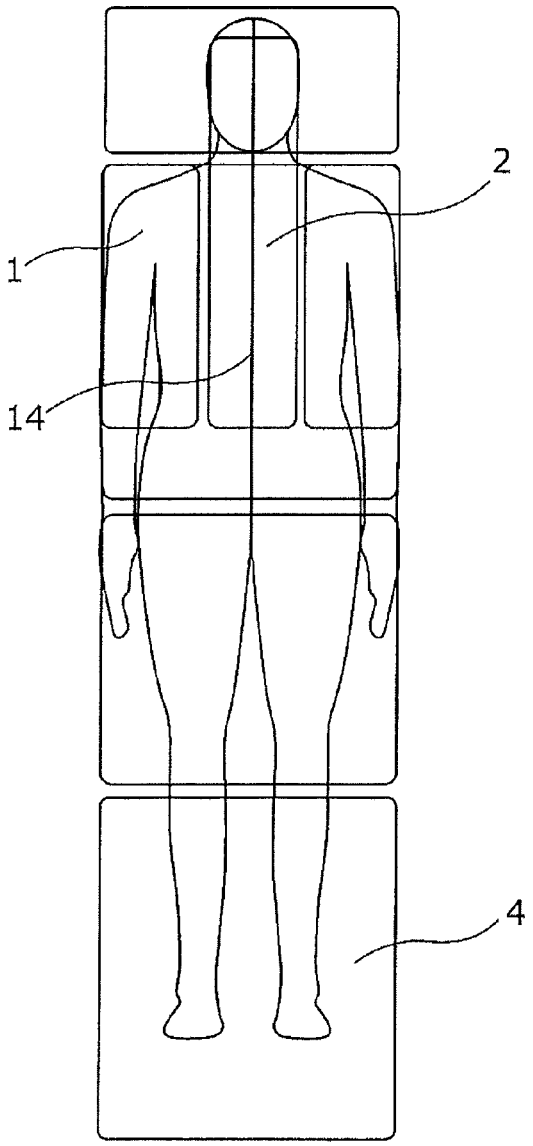
FIGS. 13A and 13B show overhead views of the third preferred embodiment in the rest position.
Figure 13B:
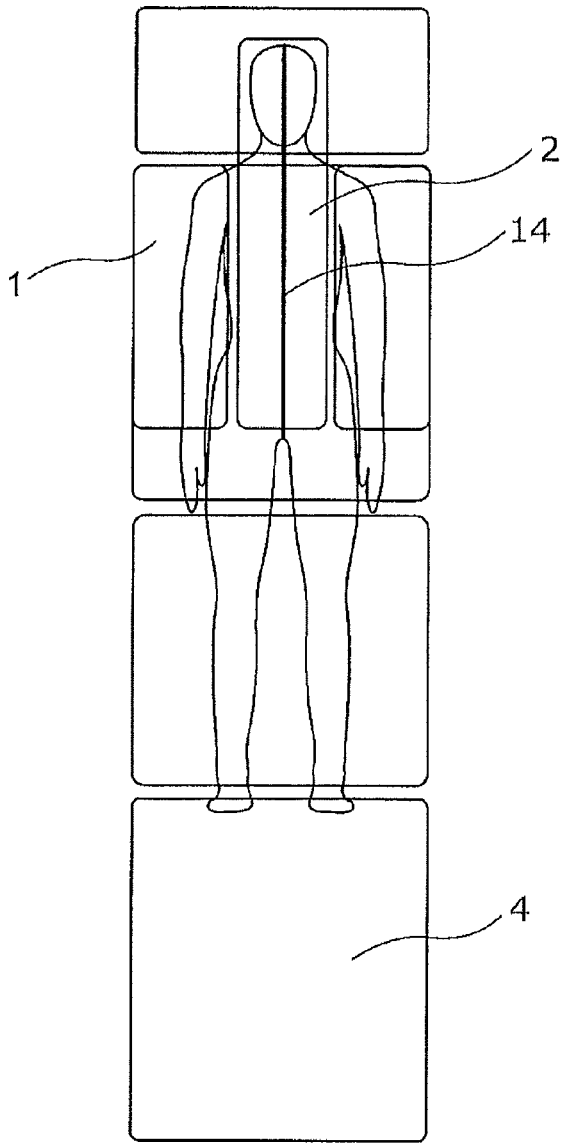

FIG. 12 shows a perspective view of a third preferred embodiment in the rest position. In this embodiment, the two contact members 1 are provided fixed to either side of the base portion 2. The base portion slat is positioned directly underneath the patient's midline 14 and the contact member slats 1 are positioned underneath the patient's scapulae as shown in FIGS. 13A (larger patients) and 13B (smaller patients).

Figure 14A:
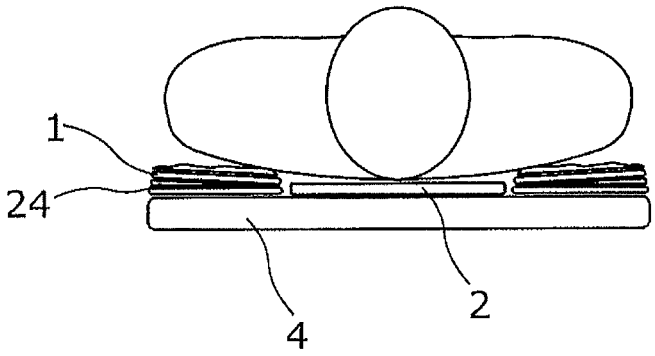
FIGS. 14A, 14B and 14C show end views of the third preferred embodiment in the rest position, grip position and grip position with protruding elements for a larger patient.
Figure 14B:
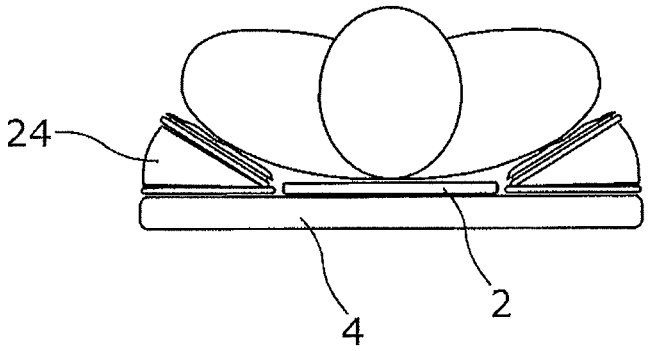
Figure 15A:
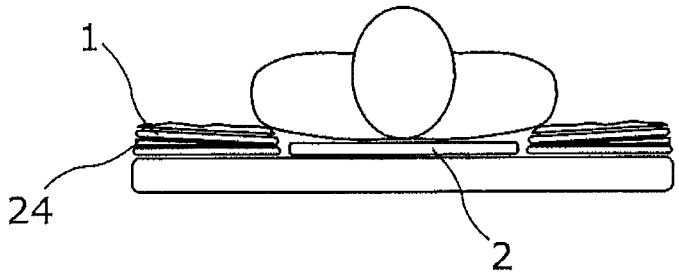
FIGS. 15A, 15B and 15C show end views of the third preferred embodiment in the rest position, grip position and grip position with protruding elements for a smaller patient.
Figure 15B:
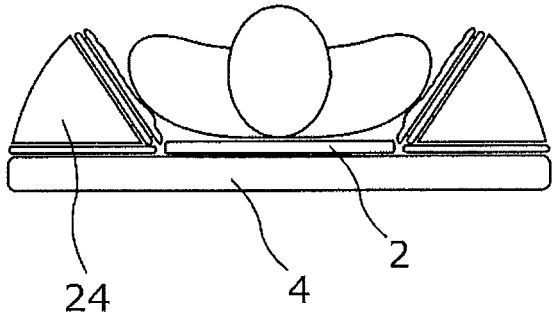
Figure 16:
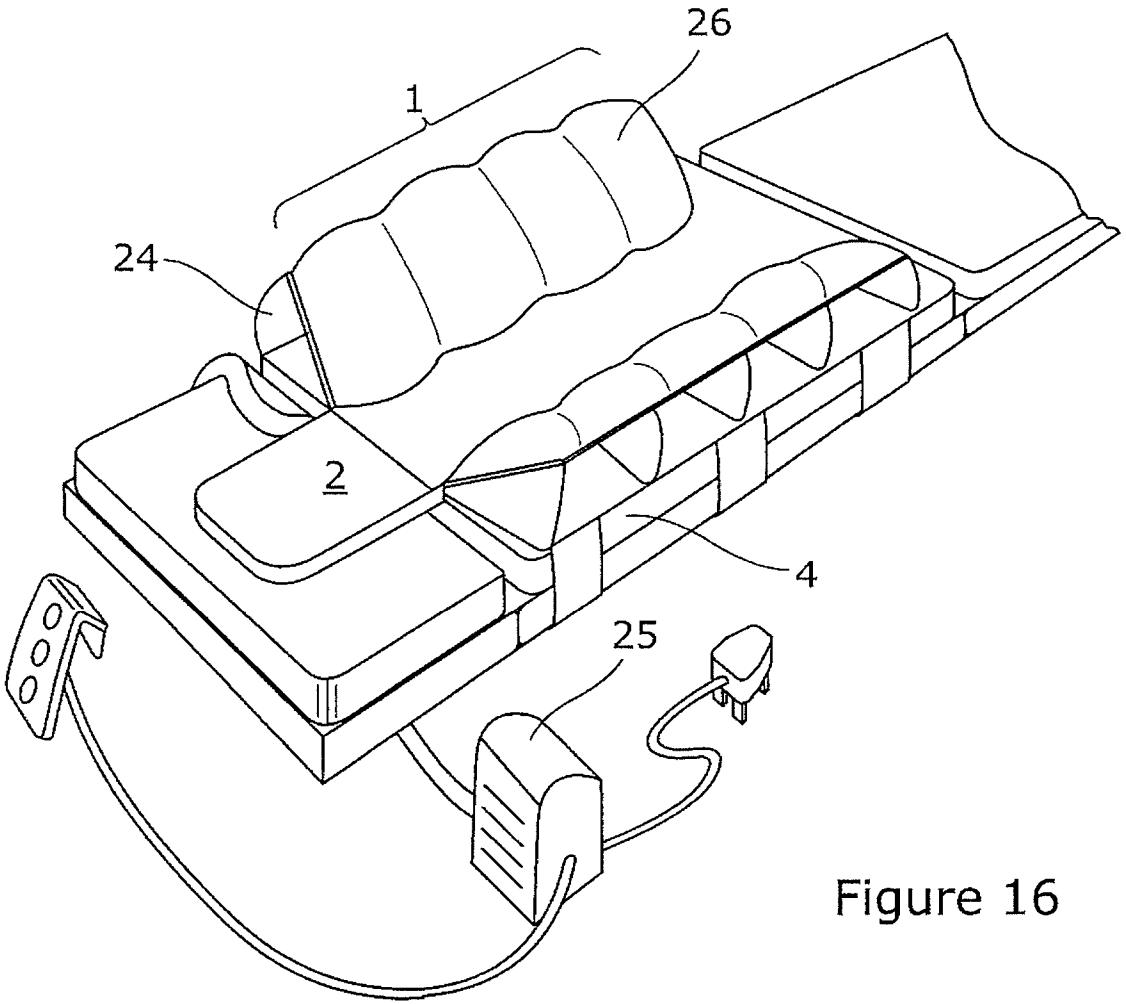
FIG. 16 shows a perspective view of the third preferred embodiment in a grip position.

Underneath each contact member is an inflatable bladder 24 (e.g. a PVC inflatable bladder) which can be seen in a deflated state (in the rest position) in FIGS. 14A and 15A. The profile of the deflated bladders is sufficiently low that the contact members can lie is a substantially horizontal plane on the operating table 4. To move the contact members into the grip position (as shown in FIGS. 14B, 15B and 16), the inflatable bladders are inflated using a compressor 25. This raises the outermost edges of the compact members 1 from the operating table so that the contact members are inclined relative to the base portion 2. In this position, the contact members 1 can exert opposing lateral forces on the scapulae to close the sternum. The inflatable bladders maintain the contact members 1 in the grip position until the air pressure in the bladders 24 is reduced (after fixing of the sternum).

Figure 14C:
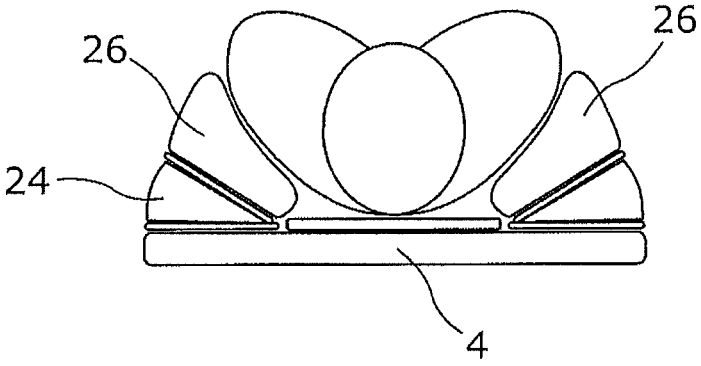
Figure 15C:
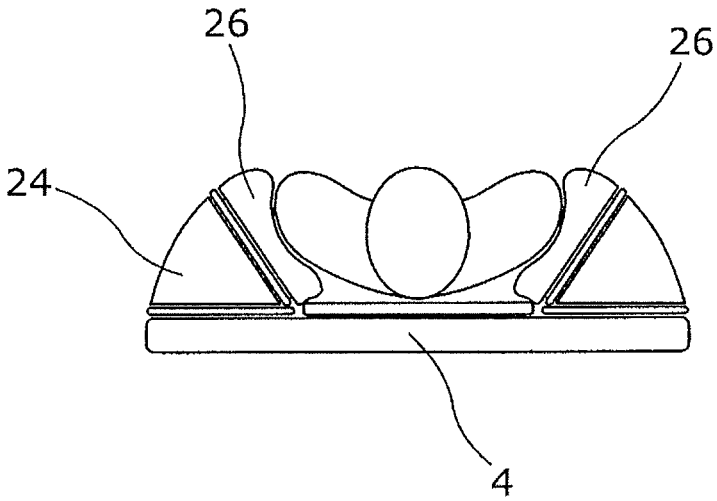

The contact members 1 additionally include secondary inflatable bladders 26 which are protrudeable elements. When the contact members 1 are in the grip position, the opposing lateral force applied by the contact members 1 to the scapulae can be further increased by inflating the secondary inflatable bladders 26 as shown in FIGS. 14C and 15C. The secondary inflatable 26 bladders can be aligned transverse to the patient's midline as shown in FIG. 16 or they can be aligned parallel to the patients' midline as shown in FIGS. 17 A, B and C.

Figure 17A:
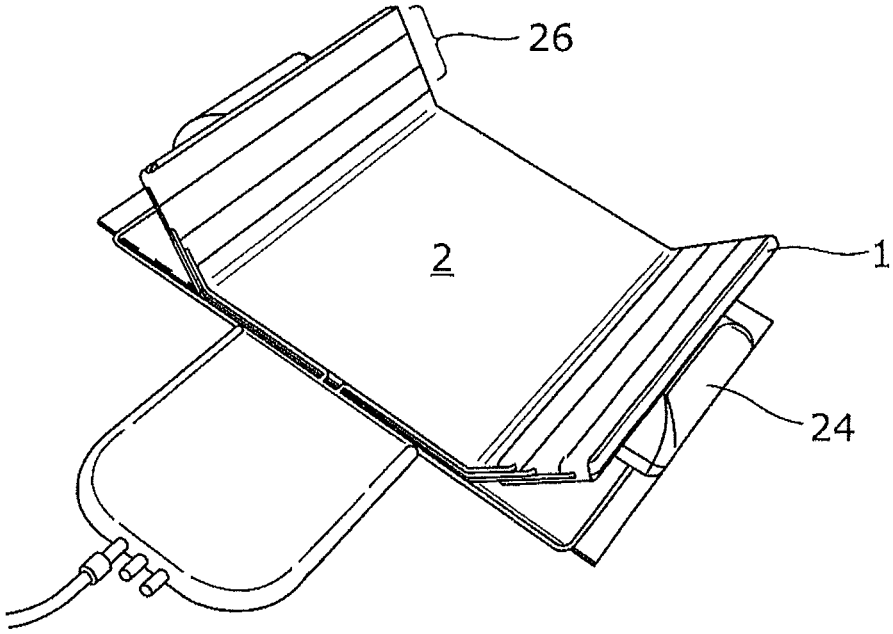
FIG. 17A shows a perspective view and FIGS. 17B and 17C shows end views of a fourth preferred embodiment.
Figure 17B:
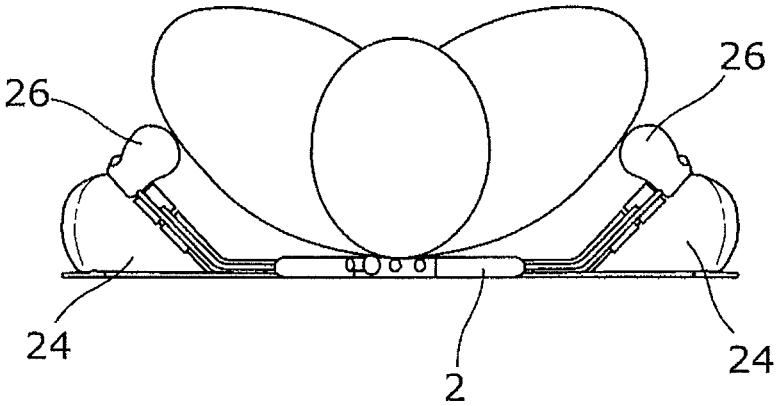
Figure 17C:
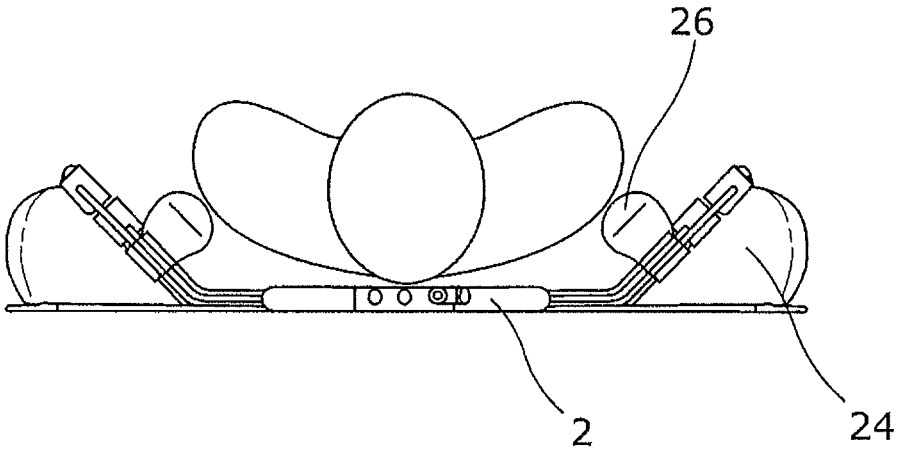

FIGS. 17A, B and C show a fourth preferred embodiment which is substantially identical to the third embodiment but which has the secondary inflatable bladders 26 aligned with the patient's midline, three bladders extending the length of each contact member 1. FIG. 17A shows the fourth preferred embodiment in the grip position with the secondary inflatable bladders 26 un-inflated. FIGS. 17B and 17C show how the secondary inflatable bladders 26 can be selectively inflated depending on the size of the patient i.e. the secondary inflatable bladders proximal the patient's scapulae can be selectively inflated. For a larger patient, the outermost secondary inflatable bladders can be inflated as shown in FIG. 17B to impart an increased force on the patient's scapulae. For a smaller patient, the innermost secondary inflatable bladder can be inflated as shown in FIG. 17C.

Figure 18:
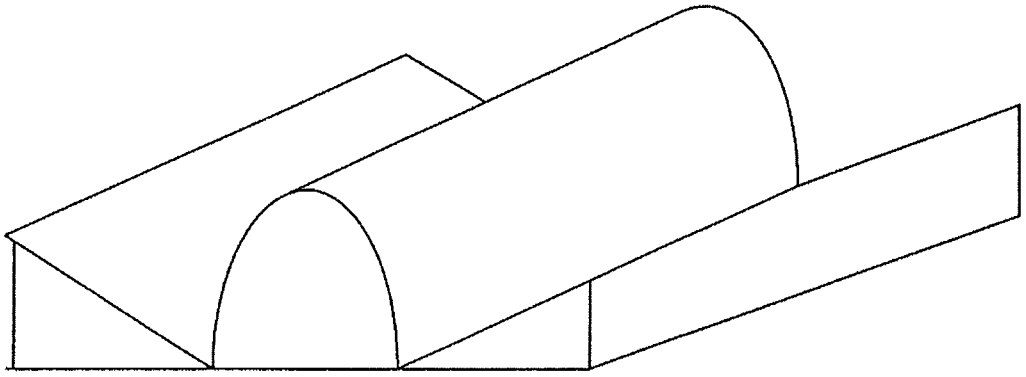
FIG. 18 shows a perspective view of an embodiment of the invention featuring further independent torso-moving means.

FIG. 18 shows a perspective view of an embodiment of the invention in which an inflation cell, aligned with the patient's midline and arranged to contact it in use, is provided.

The embodiments described above are given my way of illustration only and numerous variations and modifications will be readily apparent to a person skilled in the art.

The invention claimed is:

1. A method for closing a patient's sternum after open chest surgery, the method comprising:

providing a device having two contact members and support means, the support means being configured to maintain a grip position of the contact members;

positioning the contact members of the device underneath a respective scapula of the patient;

moving the contact members into the grip position in which a patient's shoulders are raised above the patient's sternum;

maintaining, by the support means, the contact members in a grip position such that the contact members impart a force on the respective scapula; and closing the patient's sternum.

2. The method according to claim 1, comprising:

positioning the contact members underneath a respective scapula of the patient in a substantially horizontal orientation in which substantially no lateral force is applied to the scapulae and moving the contact members into the grip position in which opposing lateral forces are applied to the scapulae.

3. The method according to claim 1, comprising:

raising at least part of the outermost edges of the contact members.

4. The method according to claim 1, comprising:

moving the contact members into the grip position using the support means.

5. The method according to claim 1, comprising:

maintaining the contact members in the grip position by mechanical, pneumatic or hydraulic support means.

6. The method according to claim 5, comprising:

moving the contact members to and/or maintaining the contact members in the grip position using pneumatic or hydraulic support means.

7. The method according to claim 6, comprising:

providing a device having an inflatable bladder located on the underside of each contact member and inflating the bladders to push at least part of the contact members into the grip position.

8. The method according to claim 1, further comprising:

increasing the lateral force on the respective scapula in the grip position by causing protrudeable elements to protrude from the contact members.

9. The method according to claim 1, wherein the contact members are in contact with a patient's shoulders.

10. The method according to claim 1, wherein the spine of the patient remains in the same vertical position as the patient's shoulders are elevated above the patient's sternum by movement of the contact members.

11. The method according to claim 1, wherein:

the contact members have a contour when in the grip position, and the contact members are configured to contact an area corresponding to the respective scapula of a patient such that the contact members remain beneath the patient.

12. A method for closing a patient's sternum after open chest surgery, the method comprising:

providing a device having two contact members and support means for maintaining a grip position of the contact members in which the contact members are configured to impart a force on the respective scapula to close the patient's sternum;

positioning the contact members of the device underneath a respective scapula of the patient;

moving the contact members into the grip position;

maintaining the contact members in the grip position using the support means; and fixing the sternum in a closed position with a patient's shoulder's raised above the patient's sternum through maintaining the contact members in the grip position.

13. The method according to claim 12, wherein the contact members are in contact with a patient's shoulders.

14. The method according to claim 12, wherein the spine of the patient remains in the same vertical position as the patient's shoulders are elevated above the patient's sternum by movement of the contact members.

15. The method according to claim 12, wherein:

the contact members have a contour when in the grip position, and the contact members are configured to contact an area corresponding to the respective scapula of a patient such that the contact members remain beneath the patient.

16. A method for maintaining a patient in a position in which the patient's sternum can be closed after open chest surgery, the method comprising:

providing a device having two contact members and inflatable bladders, the inflatable bladders being configured to maintain a grip position of the contact members;

positioning the contact members of the device underneath a respective scapula of the patient;

moving the contact members into the grip position;

inflating the inflatable bladders to maintain the contact members in the grip position such that the contact members impart a force on the respective scapula to raise a patient's shoulders above the patient's sternum; and closing the patient's sternum.

17. The method according to claim 16, wherein the contact members are in contact with a patient's shoulders.

18. The method according to claim 16, wherein the spine of the patient remains in the same vertical position as the patient's shoulders are elevated above the patient's sternum by movement of the contact members.

19. The method according to claim 16, wherein:

the contact members have a contour when in the grip position, and the contact members are configured to contact an area corresponding to the respective scapula of a patient such that the contact members remain beneath the patient.

* * * * *